US005664983A

United States Patent [19]

Hollis

[11] Patent Number: 5,664,983

[45] Date of Patent: Sep. 9, 1997

[54] FIGURE TOY DISPLAYING MUSCLE GROWTH

[76] Inventor: John Rey Hollis, 21540 Encina Rd., Topanga, Calif. 90290

[21] Appl. No.: 772,699

[22] Filed: Dec. 23, 1996

[51] Int. Cl.[6] ..... A63H 3/36

[52] U.S. Cl. ..... 446/199; 446/320

[58] Field of Search ..... 446/176, 180, 446/320, 190, 199, 321

[56] References Cited

U.S. PATENT DOCUMENTS

| | | | |
|---|---|---|---|
| 3,731,426 | 5/1973 | Lewis et al. | 446/320 |
| 3,812,613 | 5/1974 | Glass et al. | 446/320 |
| 3,992,807 | 11/1976 | Sapkus et al. | 446/320 |
| 3,995,394 | 12/1976 | Ayton | 446/320 |
| 4,183,171 | 1/1980 | Terzian | 446/320 |
| 4,259,805 | 4/1981 | Hornsby, Jr. | 446/320 X |
| 4,310,927 | 1/1982 | DeBose | 2/115 |
| 4,576,585 | 3/1986 | Balogh et al. | 446/199 |
| 4,623,319 | 11/1986 | Zaruba et al. | 446/320 X |
| 5,167,561 | 12/1992 | Rizzo | 446/224 |
| 5,419,729 | 5/1995 | Gross | 446/183 |
| 5,518,436 | 5/1996 | Lund et al. | 446/180 |

*Primary Examiner*—Mickey Yu
*Attorney, Agent, or Firm*—Charles B. Katz

[57] ABSTRACT

A figure toy having an expandable torso and a flexible elastic skin covering the torso, the skin interiorly defining a substantially airtight internal cavity. When the torso is moved to its expanded condition, a partial vacuum is produced within the cavity, causing the elastic skin to conform closely to sculptured features resembling muscles disposed on the outer surface of the underlying torso plates, thereby creating an appearance of great strength. When the torso is returned to its unexpanded condition, the figure toy achieves a more normal aspect. Actuator mechanisms are disclosed for selectively expanding the torso by swinging the figure toy's arms downwardly.

8 Claims, 4 Drawing Sheets

FIGURE TOY DISPLAYING MUSCLE GROWTH

FIELD OF THE INVENTION

The present invention relates generally to figure toys, and more particularly to a figure toy having means for selectively changing the shape and appearance of the figure toy from a normal condition to an expanded condition wherein marked muscular development is simulated.

BACKGROUND OF THE INVENTION

Figure toys have historically been items of great commercial appeal. Particularly popular among children are transformative figure toys which include body shape- and/or appearance-changing components which may be selectively manipulated by the child. The shape-changing components may simulate, for example, pregnancy (U.S. Pat. Nos. 3,812,613, issued to Glass et. al., and 4,183,171, issued to Terzian); weight gain/loss (U.S. Pat. Nos. 5,167,561, issued to Rizzo, and 5,419,729, issued to Gross); maturity (U.S. Pat. Nos. 3,992,807, issued to Sapkus et. al., and 3,995,394, issued to Ayton), and; muscular development (U.S. Pat. No. 3,731,426, issued to Lewis et. al. as well as the aforementioned Gross patent).

It has been noted by the applicant that shape-changing figure toys in the prior art have only been partially successful at simulating muscular growth or development. In particular, these devices fail to accurately depict "muscle definition" wherein the contours of individually defined muscles are visible. In addition, the expansion or muscle growth feature has been largely limited to a specific muscle or muscle group, such as the biceps.

A further disadvantage associated with many of the shape-changing figure toys in the prior art is their utilization of complex mechanical linkages and/or pump-driven devices to achieve the shape-changing function. The inclusion of such mechanisms or devices results in a substantial increase in the manufacturing cost (and consequently the retail price) of the figure toy, thereby adversely affecting its commercial viability.

SUMMARY OF THE INVENTION

It is therefore an object of the present invention to provide a figure toy having means for selectively changing the shape and appearance thereof from a first condition in which the figure toy has a normal aspect to a second condition wherein the figure toy assumes an expanded muscular aspect.

It is a more specific object of the invention to provide a figure toy having improved means for simulating muscular definition.

It is another object of the invention to provide a transformative figure toy which may be relatively inexpensively manufactured.

It is a further object of the invention to provide a figure toy including accessories in the form of a covering fitted about the torso of the figure toy, said covering comprising releasable closures causing the covering to break away from the figure toy when the figure toy is moved to its expanded condition.

Other and further objects of the invention will be apparent to those skilled in the art upon review of the following description and the accompanying figures.

In accordance with the present invention, a figure toy is provided having an expandable torso structure covered by an elastic gas-impermeable skin. The skin interiorly defines a substantially airtight cavity which is held at atmospheric pressure when the torso is placed in the normal condition. The torso structure is mechanically linked to the figure's arms, whereby swinging the arms downwardly causes the front, back and shoulder components of the torso to move outwardly and upwardly to the expanded condition. In the expanded condition, the torso components bear against and stretchingly engage the elastic skin, thereby expanding the volume of the interior chamber and consequently producing a partial vacuum within the cavity. The pressure differential between the interior chamber and the atmosphere causes the skin to closely conform to the underlying torso plates, which include sculptured features representative of highly-developed muscles. The close conformation of the skin to the underlying torso components produces the appearance of well-defined musculature.

When the figure's arms are swung upwardly, the associated torso structure components are retracted inwardly and downwardly, and the skin returns to its normal condition, returning the pressure therewithin to the atmospheric pressure. In the absence of the partial vacuum within the aforementioned torso cavity, the figure's skin more loosely overlies the torso structure components, and consequently the simulated muscles are much less visibly evident and a normal appearance is thereby achieved.

The figure toy is preferably additionally provided with a break-away covering fitted about the figure's torso, exterior to the skin. The covering typically comprises two or more pieces joined with releasable closures. When the figure is moved to the expanded condition, the closures release, causing the covering to break apart and fall from the figure. After the figure is returned to the normal condition, the covering may be replaced and fastened together around the figure.

DETAILED DESCRIPTION OF PREFERRED EMBODIMENTS

Figure 1:
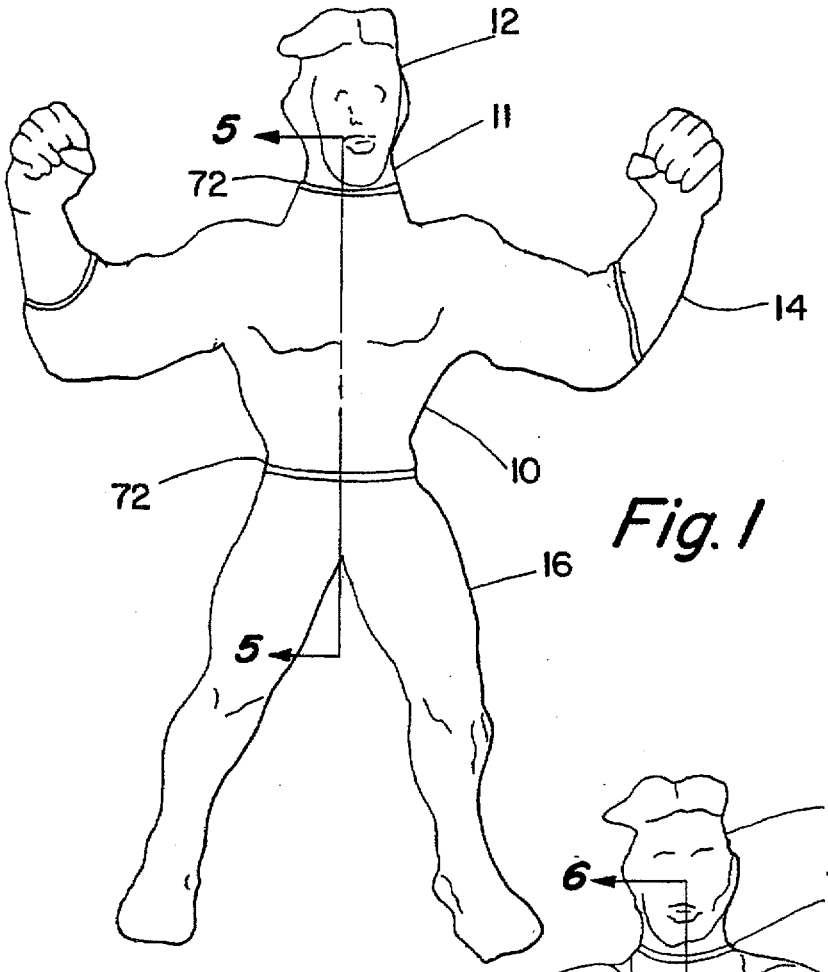
FIG. 1 is a from elevational view of a figure toy according to the present invention depicting the toy's torso in its normal condition.

Reference being directed generally to the figures, wherein like numerals denote like parts, it is seen that there is provided according to the present invention a figure toy being generally human or humanoid in appearance. The figure comprises a torso 10 to which neck 11, head 12, arms 14 and legs 16 are attached. In a typical construction of the figure toy, legs 16 are adapted with transverse bosses (not shown herein) pivotally mounted within corresponding bores formed in the lower portion of the torso to enable the legs to be pivoted relative to the torso.

Figure 2:
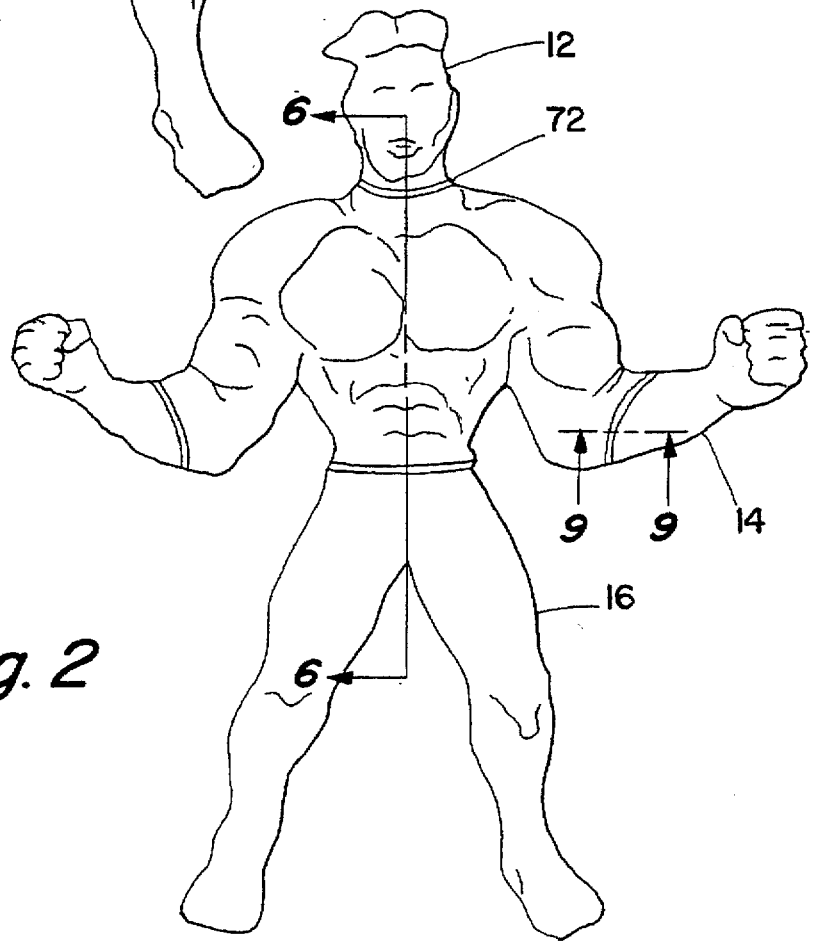
FIG. 2 is a front elevational view of the figure toy depicting the torso in its expanded condition.
Figure 3:
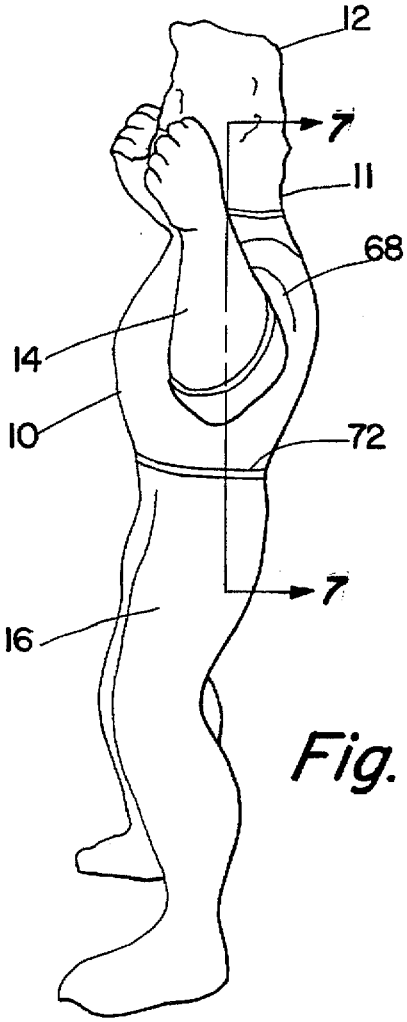
FIG. 3 is a side elevational view of the figure toy with the torso in its normal condition.
Figure 4:
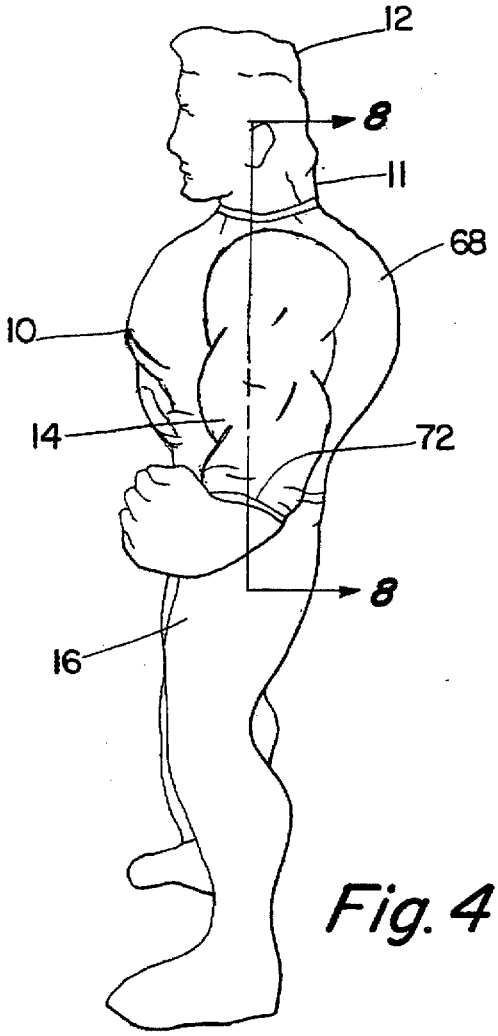
FIG. 4 is a side elevational view of the figure toy with the torso in its expanded condition.

As will be discussed in greater detail below, torso 10 is selectively movable between a first normal condition and a second expanded condition, thereby simulating the figure's transformation from a normal appearance to a heavily muscled appearance suggestive of great strength. Expansion of torso 10 from the normal condition is effected by swinging rotatably mounted arms 14 downwardly and inwardly from a first position depicted in FIG. 1 to the second position depicted in FIG. 2. To return the torso to its normal condition, arms 14 are swung upwardly from the second position to the first position.

Figure 7:
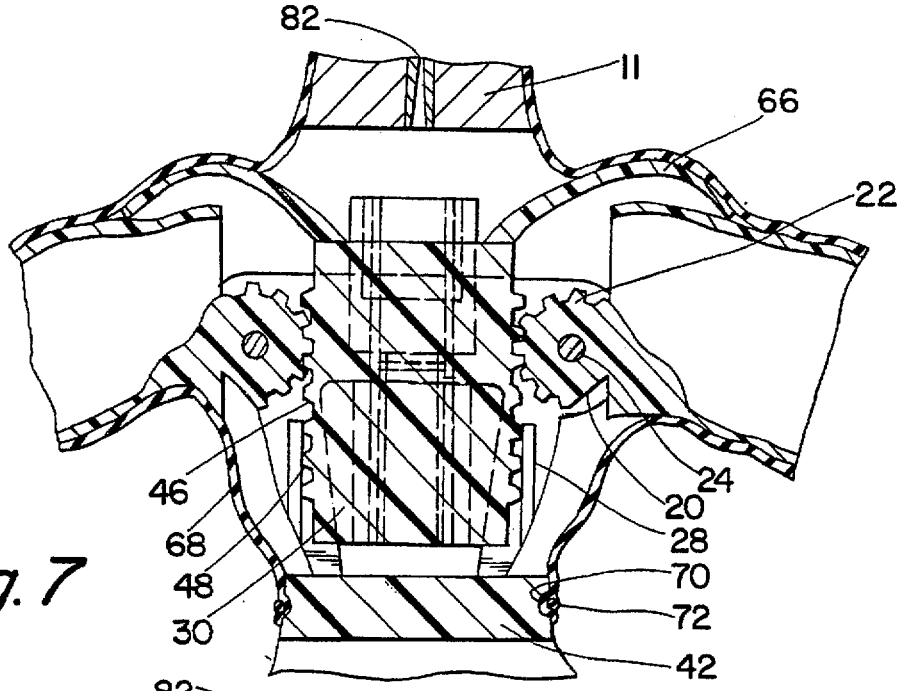
FIGS. 7 and 8 are sectional views taken respectively along line 7—7 of FIG. 3, and line 8—8 of FIG. 4, depicting particularly the action of the arms and shoulder members relative to the torso-expansion mechanism in the normal and expanded positions.
Figure 8:
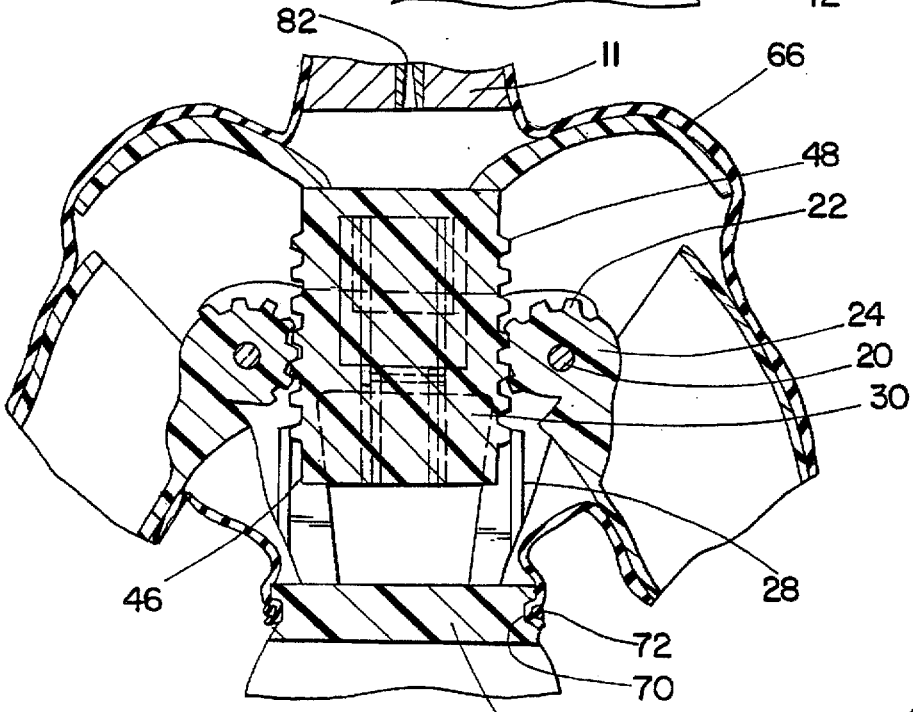

As may best be discerned by reference to FIGS. 7 and 8, arms 14 are provided at their inner end with pinions 20, the pinions being formed integrally therewith or attached in fixed relation thereto. Pinions 20 are adapted around their circumference with regularly spaced teeth 22. As viewed from the front of the figure, the pinion attached to the left arm rotates in a clockwise direction when the arms are swung downwardly, while the right arm pinion rotates in a counter-clockwise direction. The pinions include short transverse axles 24 journalled in openings formed in the opposite upper corners of frame 28 thereby rotatably mounting arms 14 to the figure toy's torso 10.

Figure 6:
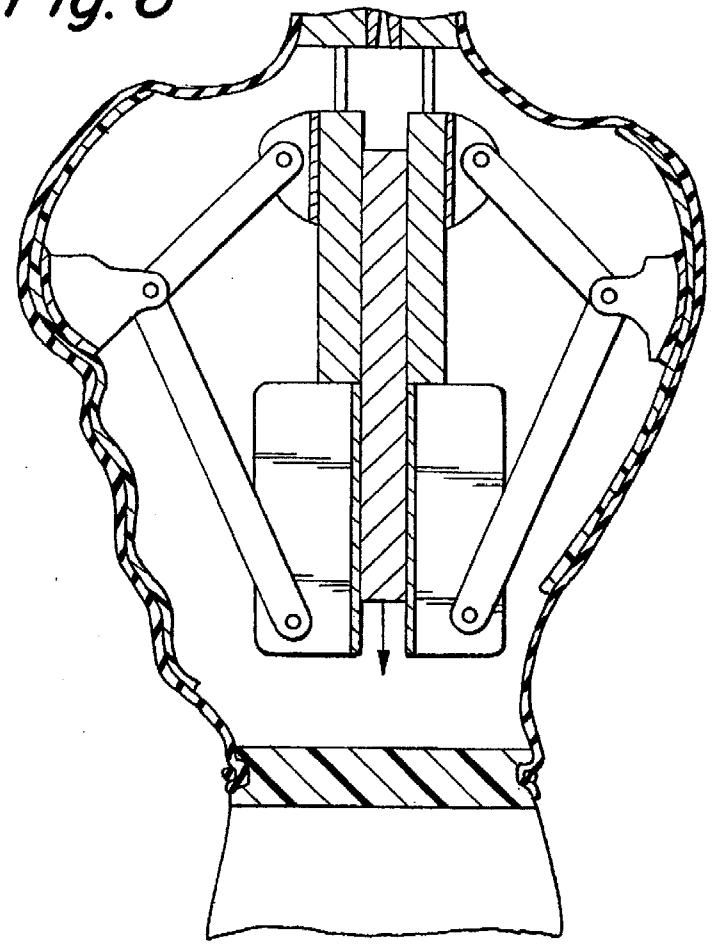
FIGS. 5 and 6 are sectional views taken respectively along line 5—5 of FIG. 1 and line 6—6 of FIG. 2, depicting the relationship of the torso-expansion structure elements in the normal and expanded positions.
Figure 5:
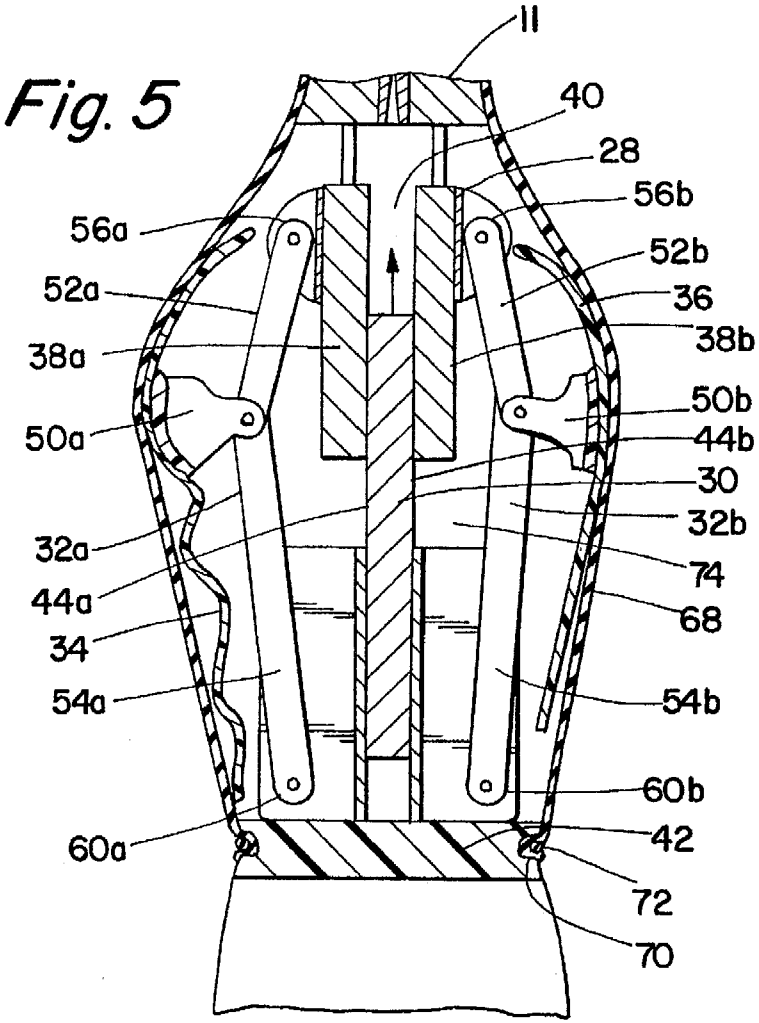

Making additional reference to FIGS. 5 and 6, the expansion and retraction of torso 10 is achieved by the associated movement of pinions 20, actuator plate 30, front and rear scissor members 32*a,b* and front and rear torso shells 34 and 36. Actuator plate 30 is mounted for vertical sliding motion within frame 28. The frame comprises front and rear plates 38*a,b* being in parallel relation and slightly spaced apart to define channel 40 in which actuator plate 30 may move upward to the expanded torso position and downward to the normal torso position. The bottom ends of frame front and rear plates 38*a,b* are bridged by waist plug 42, thereby forming a floor limiting the downward travel of actuator plate 30. It is noted that the central portions of front and rear frame plates 38*a,b* are cut out allowing access to actuator plate 30 therethrough.

Actuator plate 30 includes front and rear surfaces 44*a,b* and vertical sides 46. Vertical sides 46 are adapted with regularly spaced teeth forming racks 48 which meshingly engage pinions 20 mounted in frame 28. Starting with the normal torso condition shown in FIG. 7, rotation of arms 14 downwardly causes actuator plate 30 to slide upward relative to fixed frame 28. The movement of actuator plate 30 is reversed by returning the arms to their upward or first position.

Positioned generally exteriorly to frame 28 and actuator plate 30 are front and rear torso shells 34 and 36. As discussed in further detail hereinbelow, the outwardly directed surfaces of the front and rear torso shells are adapted with surface contouring representative of muscle groups, such as the abdominal, pectoral and dorsal muscles. Reference being made to FIGS. 5 and 6, the front and rear torso shells are attached to actuator plate 30 and frame 28 by front and rear scissor members 32*a,b* which serve to convert the sliding motion of the actuator plate to a relative together-and-apart motion of the shell members. The scissor members are each provided with pivoting joint 50*a,b* located intermediate the upper and lower ends thereof, the joint defining upper arms 52*a,b* and lower arms 54*a,b*. The upper end of front scissor member 32*a* is pivotally connected to the upper portion of frame 28 via hinge mount 56*a*, while the lower end of front scissor member 32*a* is pivotally connected to front surface 44*a* of actuator plate 30 via hinge mount 60*a*. The intermediate jointed portion of front scissor member 32*a* is pivotally connected to the inward directed surface of front torso shell 34. Similarly, the upper end of rear scissor member 32*b* is pivotally connected to frame 28 via hinge mount 56*b* and the lower end is connected to rear surface 44*b* of actuator plate 30 via hinge mount 60*b*. The jointed portion of the rear scissor member is pivotally connected to the inward directed surface of rear torso shell 36.

The operation of scissor members 32*a,b* is best understood by reference to FIGS. 5 and 6. In FIG. 5, depicting torso 10 in its normal condition, front and rear torso shells 34 and 36 are positioned in relatively close proximity. When actuator plate 30 is forced to slide upward by rotation of arms 14 and associated pinions 20, as shown in FIG. 6, the lower ends of the front and rear scissor members are carried upward, in turn causing the jointed portions thereof to be levered outward. In the expanded condition, the front and rear torso shells are relatively spaced apart, thereby expanding the volume of the torso and producing an appearance of great strength. It is appreciated that in the preferred construction of the figure toy depicted in the figures, upper arms 52*a,b* of the front and rear scissor members are somewhat shorter than lower arms 54*a,b* thereof. This geometry causes the upper ends of the torso shells to be forced apart to a greater extent than the lower ends, thereby causing a more marked expansion of the torso in the areas of the shoulders and upper chest. When the actuator plate is slid downwards by swinging arms 14 upwardly, the torso shells are returned to their relatively spaced together condition as shown in FIG. 5.

Actuator plate 30 is further provided at its upper end with shoulder extension members 66. As depicted in FIG. 8, when arms 14 are swung downwardly, shoulder extension members 66 are moved upwardly, via the associated upward sliding of the actuator plate, and bear against and stretch the adjacent skin 68, producing an appearance of well developed shoulder muscles. When the torso is returned to the normal condition by swinging the arms upwardly, the shoulder member extensions are retracted from the skin, and a more normal, less heavily muscled appearance is achieved in the shoulder region.

Figure 9:
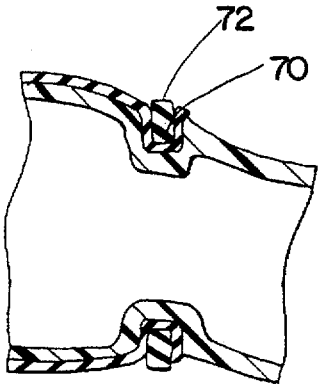
FIG. 9 is a sectional view of the figure toy's arm taking along line 9—9 of FIG. 2, showing particularly the arrangement of sealing elements at the margin of the skin.

An essential feature of the present invention is the utilization of skin 68 overlying the torso to enhance the lifelike appearance of the figure and to highlight the muscular transformation thereof. Skin 68 is formed from a thin, elastic and substantially gas-impermeable material. In a typical construction, a latex elastomer having a thickness of about 1/1000" (0.25 mm) is employed to form the skin. To achieve a seal at the margins of the skin, circumferential grooves 70 are formed in the upper arms, waist and neck of the toy. Corresponding ties 72 positioned exteriorly to the skin and tensioned during manufacture compress the skin within the grooves to effect a seal, as depicted in FIG. 9. Alternatively, the skin may be sealed at its margins to the underlying solid structure by an adhesive sealant.

The skin defines interiorly thereto sealed torso cavity 74 which enables the aforementioned muscle definition enhancing vacuum effect. A fixed quantity of a gas, typically air, occupies the torso cavity. With torso 10 in the normal condition, the gas held within the torso cavity has a pressure equal to the atmosphere exterior to the skin. When the torso is moved to the expanded condition, front and rear torso shells 34 and 36 and shoulder extension members 66 bear against and stretch the adjacent skin outward, resulting in an expansion of the volume of cavity. Since the quantity of gas held within the cavity is fixed, the expansion of the cavity volume results in the creation of a partial vacuum (sub-atmospheric pressure) therewithin. The partial vacuum causes the skin to closely conform to the underlying front and rear torso shells. As described hereinabove, the outer surfaces of the torso shells are contoured to simulate highly developed and defined musculature, which musculature becomes visually apparent when the skin is caused to closely conform to the underlying shells via the vacuum effect. The close conformation of the skin to the underlying structures is improved by adapting the torso shells with holes extending therethrough in regions which are deeply recessed, e.g. at the periphery of individual muscles.

When the torso is moved to the normal condition from the expanded condition, the volume of the torso cavity is reduced thereby returning the pressure of the gas therewithin to atmospheric. Due to the absence of a pressure differential across the skin, the skin more loosely overlies the torso shells, and hence the simulated muscles are considerably less visually evident. Thus a less muscled, more normal appearance is achieved.

Figure 11:
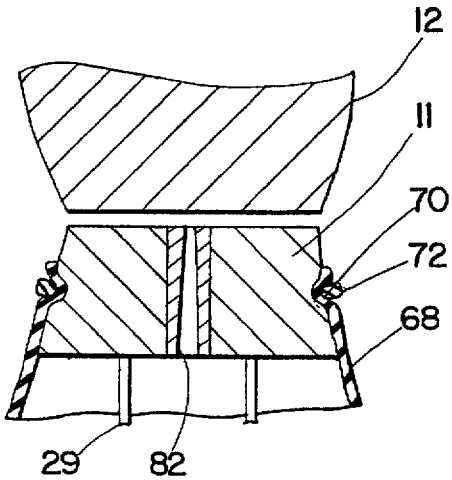
FIG. 11 is a fragmentary cross-sectional view taken through the neck portion of the figure toy.

It has been observed that if the figure toy is maintained with the torso in the expanded condition for a prolonged period of time, ambient air may tend to flow into the reduced-pressure interior cavity via small leaks in the skin and at the margins thereof. The leakage of air into the torso interior cavity results in an increase in pressure therein and causes a corresponding diminution of the aforementioned vacuum effect. Furthermore, when the figure toy is returned to its normal condition after leakage has occurred, positive (super-atmospheric) pressure is developed within the interior cavity causing the skin to balloon outwardly from the underlying torso shells. With a view toward remedying this problem, neck 11 (depicted in FIG. 11) is advantageously provided with positive pressure relief valve 82 which opens and permits the flow of air from the cavity to the exterior when the pressure within the cavity exceeds the atmospheric pressure. The relief valve may be of any suitable type, such as a ball check valve, reed valve or duckbill valve. In practice, when the figure toy's torso is returned to its normal condition from an extended period of time in the expanded condition, during which substantial leakage into the cavity has occurred, the reduction in the cavity volume causes positive pressure to be developed therewithin, causing the valve to open and allow air to be expelled from the cavity until the pressure within the cavity is equal to the atmospheric pressure, at which time the valve closes. This action allows a partial vacuum to be subsequently developed within the cavity when the torso is expanded.

Figure 10:
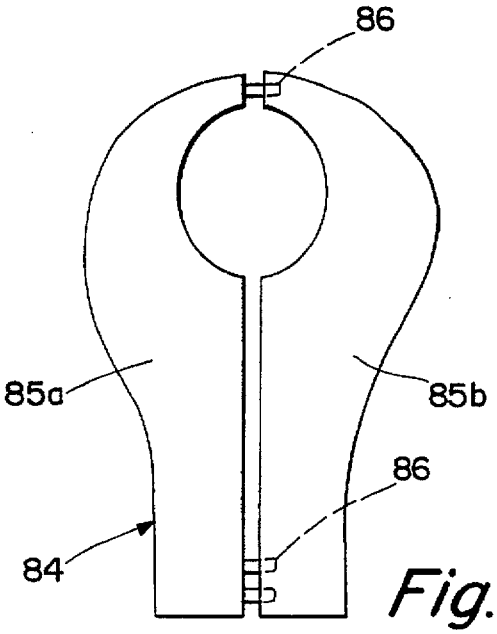
FIG. 10 is a side elevational view of the optional break-away torso covering.

To dramatize the transformation of the figure toy from its normal condition to its expanded, highly muscular state, the toy is preferably provided with break-away covering 84 encircling at least a portion of torso 10 exteriorly to skin 68. The covering may be formed and decorated to simulate body armor, or may represent a shirt or other garment. In the form depicted in FIG. 10, the covering comprises front and rear pieces 85*a,b* joined together by releasable closures 86 disposed at the sides of the torso. The releasable closures depicted herein are of the detent ("snap") type, but any suitable releasable closures, including Velcro®-type hook and loop fasteners, may be substituted therefor. It is appreciated that the closures are oriented parallel with the direction of expansion of the torso such that when the torso is moved to its expanded condition, the stress placed on the closures by the expansion of the torso causes the closures to release and the armor pieces to separate and fall from the toy, highlighting the transformative action of the figure toy. When the torso is returned to the normal condition, the from and rear pieces may be replaced to the torso and joined together via the releasable closures. A single-use covering may alternatively be fabricated from a thin tearable material such as paper. according to this embodiment of the covering, the expansion of the torso will cause the material to tear and separate from the torso.

It is to be understood that the foregoing detailed description of preferred embodiments of the invention is provided by way of example only. Various details of design and construction may be modified without departing from the true spirit and scope of the invention, which is not limited to the foregoing description, but instead is set forth in the following claims.

What is claimed is:

1. A figure toy comprising:

a torso structure movable between a normal condition and an expanded condition, said torso structure being provided with front and rear torso shell members separately mounted to actuator means disposed generally interiorly to said front and rear torso shell members, said front and rear torso shell members having an outwardly directed surface contoured to simulate well-developed musculature;

arms pivotally connected to said torso structure, said arms being selectively pivotable between a first upraised position and a second lowered position, the inward ends of each of said arms being provided with a pinion in operative engagement with said actuator means such that moving said arms to said lowered position from said upraised position causes said front and rear torso shell members to be moved from said normal condition wherein said front and rear torso shell members are positioned in relative proximity to each other to said expanded position wherein said front and rear torso members are relatively spaced apart;

a generally flexible, elastic and impermeable skin overlying said torso structure and areas of said figure toy adjacent thereto, said skin being in sealed engagement with the underlying structure at the margins of said skin, said skin interiorly defining a substantially airtight cavity, the gas occupying said cavity being approximately at atmospheric pressure when said torso structure is in said normal condition, and;

the volume of said cavity being enlarged and the gas pressure within said cavity being correspondingly reduced when said torso structure is moved to said expanded condition such that a partial vacuum is created within said cavity, said partial vacuum causing said skin to closely conform to the simulated musculature formed on the outer surface of said front torso shell member;

whereby moving said arms from said upraised position to said lowered position causes a visual change in said figure toy from a relatively normal appearance to a heavily muscled appearance, and moving said arms from said lowered position to said upraised position causes said figure toy to return to its relatively normal appearance.

2. A figure toy according to claim 1 wherein said actuator means comprise:

an actuator plate slidably mounted within a frame, the vertical sides of said actuator plate being adapted with racks in engagement with said pinions wherein pivoting said arms from said upraised position to said lowered position causes said plate to slide upwards within said supporting means;

front and rear scissor members respectively mounting said front torso shell member and said rear torso shell member to said actuator plate and said frame, said scissor members each having a pivot joint disposed intermediate to the upper and lower ends thereof;

said front scissor member having its upper end pivotally attached to the front surface of said frame proximal to the upper section thereof and its lower end pivotally attached to the front surface of said actuator plate proximal to the lower section thereof, said front scissor member having its intermediate pivot joint attached to the inwardly directed surface of said front torso shell member, and;

said rear scissor member having its upper end pivotally attached to the rear surface of said frame proximal to the upper section thereof and its lower end pivotally attached to the rear surface of said actuator plate proximal to the lower section thereof, said rear scissor member having its intermediate pivot joint attached to the inwardly directed surface of said rear torso shell member;

whereby the upward sliding motion of said plate occasioned by the movement of said arms to said lowered position causes said pivot joints of said front and rear scissor members and said front and rear torso shell members attached thereto to be levered outward to said expanded condition.

3. A figure toy according to claim 2, wherein said actuator plate carries at its upper end two opposed shoulder members, said shoulder members bearing against said skin when said torso structure is moved to said expanded condition, whereby enlargement of the shoulder muscles is simulated when said arms are moved to said lowered position.

4. A figure toy according to claim 1 wherein said skin is comprised of a latex elastomer.

5. A figure toy according to claim 1 further comprising break-away covering means adapted to conform to said torso of said figure toy exteriorly to said skin when said torso is in said normal condition, said covering means releasing and falling away from said torso when said torso is moved to said expanded condition.

6. A figure toy according to claim 5 wherein said covering means comprises front and rear armor plates joined at the sides of said torso by releasable closures, said closures releasing when said torso is moved to said expanded condition.

7. A figure toy comprising:

a torso having arms and legs attached thereto, said torso being movable between a retracted condition and an expanded position, said torso having an outer surface contoured to simulate musculature;

said arms being selectively movable between a first and a second position and being in mechanical association with said torso such that moving said arms from said first position to said second position causes said torso to be moved to said expanded position, and moving said arms from said second position to said first position causes said torso to be returned to said retracted position;

an elastic, substantially impermeable skin overlying said torso and areas of the toy adjacent thereto and being in sealed engagement therewith at the margins of said skin, said skin defining a substantially airtight interior cavity, said interior cavity having a first volume when said torso structure is in said retracted condition and a second larger volume when said torso structure is in said expanded condition;

the expansion of said interior cavity from said first volume to said second volume resulting in a corresponding decrease in pressure within said interior cavity from a first substantially atmospheric pressure to a second sub-atmospheric pressure, wherein moving said torso structure to said expanded condition causes said skin to closely conform to said contouring carried on said torso outer surface thereby enhancing the muscular appearance of said toy.

8. A figure toy according to claim 7 further comprising break-away covering means adapted to conform to said torso of said figure toy exteriorly to said skin when said torso is in said normal condition, said covering means releasing and falling away from said torso when said torso is moved to said expanded condition.

* * * * *